United States Patent [19]

Stouffer

[11] 4,292,705

[45] Oct. 6, 1981

[54] TONGUE TOOTHBRUSH

[76] Inventor: James F. Stouffer, Rte. 11, Box 443, Chambersburg, Pa. 17201

[21] Appl. No.: 41,098

[22] Filed: May 21, 1979

[51] Int. Cl.[3] ..... A46B 5/04

[52] U.S. Cl. ..... 15/110; 15/167 R; 15/227; 132/84 D; 132/92 R

[58] Field of Search ..... 15/167 R, 227, 110; 132/89, 91, 92 R, 92 A, 84 D

[56] References Cited

U.S. PATENT DOCUMENTS

| | | | |
|---|---|---|---|
| 1,465,522 | 8/1923 | Lunday | 15/227 X |
| 1,894,413 | 1/1933 | Nenning et al. | 15/167 R X |
| 2,112,184 | 3/1938 | Vogan | 15/227 X |
| 2,113,439 | 4/1938 | Bean | 132/92 R |
| 2,167,129 | 7/1939 | Sleeper | 15/167 R X |
| 2,686,325 | 8/1954 | Silver | 15/227 X |
| 2,754,833 | 7/1956 | Vecchio | 132/91 |
| 2,778,045 | 1/1957 | Bly et al. | 15/167 R X |
| 2,883,691 | 4/1959 | Gruenwald | 15/167 R |
| 3,675,264 | 7/1972 | Storandt | 15/227 X |
| 3,959,842 | 6/1976 | Alley | 15/167 R |
| 4,030,845 | 6/1977 | Deckert | 15/167 R X |

FOREIGN PATENT DOCUMENTS

| | | | |
|---|---|---|---|
| 81611 | 6/1895 | Fed. Rep. of Germany | 15/277 |
| 575672 | 8/1924 | France | 15/227 |
| 167906 | 9/1920 | United Kingdom | 15/227 |
| 398919 | 9/1933 | United Kingdom | 15/227 |
| 1265270 | 3/1972 | United Kingdom | 15/167 R |

*Primary Examiner*—Chris K. Moore

*Attorney, Agent, or Firm*—Thomas E. Beall, Jr.

[57] ABSTRACT

A tongue toothbrush has a hollow, pliable body made of thin film material to envelope the outer portion of the tongue and carry on its terminal end short filaments for brushing the teeth with movement of the tongue. The filaments may be composed of brush bristles permanently or detachably mounted. Additionally, abrasive material may be attached to the body rearwardly of the bristles along with a hard rubber tip for gum massage mounted on the outermost portion of the body. The device may be reuseable, disposable, or composed entirely of edible material.

16 Claims, 5 Drawing Figures

FIG. 4
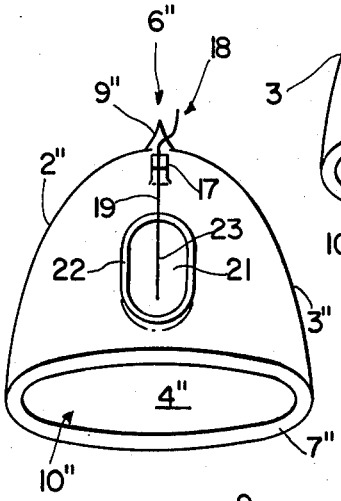
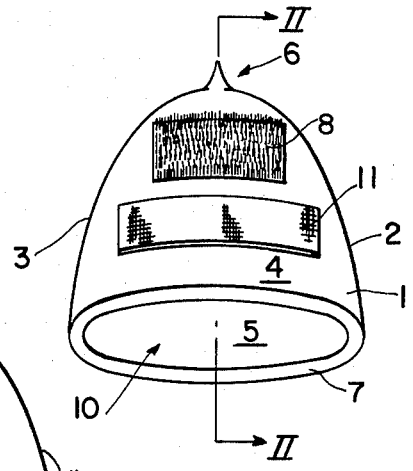
FIG. 1
FIG. 5
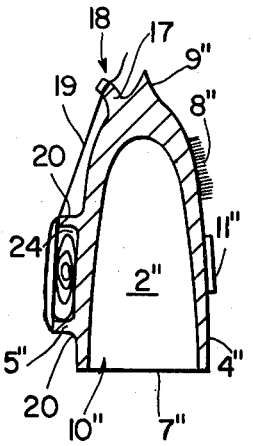
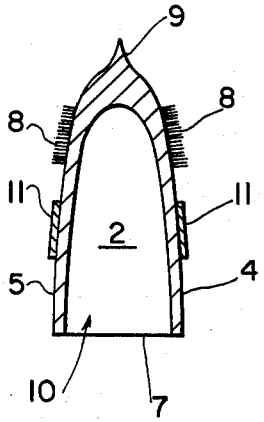
FIG. 2
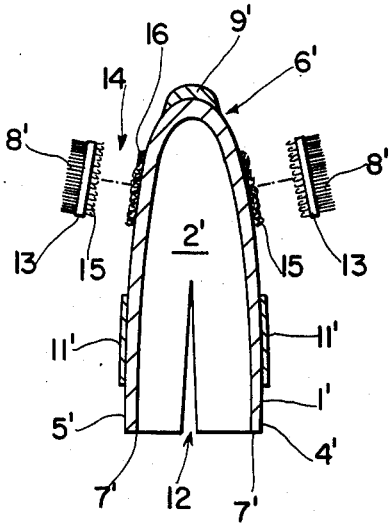
FIG. 3

TONGUE TOOTHBRUSH

BACKGROUND OF THE INVENTION

A tongue toothbrush employing wires is known from U.S. Pat. No. 3,959,842, issued June 1, 1976, but this construction is uncomfortable for the wearer, not easily adaptable to different sized tongues, relatively expensive, and not convenient to carry in a compact package.

A toothbrush to fit over the finger of the user is known from U.S. Pat. No. 1,894,413, issued Jan. 17, 1933. Dentifrice is employed with the bristles. This construction, though convenient, is not adaptable to the tongue and requires that the user occupy at least one hand while brushing the teeth.

It is known to employ a hollow body for attachment to the tongue of a user in holding a toothpick, from U.S. Pat. No. 1,465,522, issued Aug. 21, 1923.

There is a need for a cheaply manufactured, easily stored, and readily usable toothbrush that may be used without necessity of employing the hands, so that the hands may be free for other usage. The prior art has not met this need.

SUMMARY OF THE INVENTION

It is an object of the present invention to provide a toothbrush that is easily usable, easily and compactly stored, and cheap in construction, particularly to be used without employing the hands.

A tongue toothbrush has a hollow, pliable body made of thin film material to envelope the outer portion of the tongue and carry on its terminal end short filaments for brushing the teeth with movement of the tongue. The filaments may be composed of brush bristles permanently or detachably mounted. Additionally, abrasive material may be attached to the body rearwardly of the bristles along with a hard rubber tip for gum massage mounted on the outermost portion of the body. The device may be reuseable, disposable, or composed entirely of edible material.

The tongue toothbrush is used by running the tip of the tongue over all of the teeth, particularly by rubbing it on the inside and outside of the upper and lower teeth, which is quite easy to accomplish with the pliable hollow body having the bristles on its upper and lower surfaces, which cannot be accomplished with the prior art devices. Further, the employment of a rigid tip on the body will permit massaging of the gums in a like manner. The hollow body will fit over the tongue so that a hard rubber projection can be used to massage the gums, and soft abrasive material or short bristles may be used for the brushing of the teeth.

The pressure of the tongue pressing the device against the teeth will keep the device on the tongue and in complete control during the cleaning process and gum messaging. It is preferable to place the bristles and abrasives spaced slightly to the rear of the tip, where they will be most effective in brushing the teeth due to the hollow nature of the body and its flexibility so that the body will not interfere with the normal bending and twisting of the tongue that will permit the upper and lower portion of the tongue, immediately to the rear of the tip of the tongue, to be able to engage all of the tooth surfaces.

Preferably, this device will be constructed of different sizes to fit correspondingly different sized tongues, although it is also contemplated that it may be resilient so that one size will fit all or larger ranges of people.

The device may be constructed of permanent materials so that it may be used repeatedly until the brush is worn out, or, in addition, the brush may be detachably mounted on the body so that it may be replaced when it is worn out. Alternatively, the device may be cheaply constructed so that it can be thrown away after one or more uses, or the cheap construction may be such that the materials are entirely edible so that after a single use, the toothbrush may be swallowed to eliminate the disposal problem. In any event, it is desired that a flavor such as mint, cherry, biacca, spearmint, etc., be employed so that its usage will be more pleasant.

For massaging the gums, the tip of the body may be constructed thicker than the remainder of the body, so that it will be correspondingly harder, or alternatively, a harder material may be placed at this point, which may or may not have a conical type of projection. A dental floss holder and storage compartment is provided.

The device will not necessarily eliminate usage of the standard toothbrush, but it is primarily designed to permit a method of brushing the teeth and massaging the gums without the use of a standard toothbrush. This is particularly desirable when away from home, where the usage of a standard toothbrush would be conspicuous or present difficulties in storage. Also, the brushing of the teeth may be accomplished without usage of the hands, which in addition to eliminating the visible signs of brushing the teeth, will have the advantage that the hands may be used for other purposes, such as driving a car or working.

BRIEF DESCRIPTION OF THE DRAWING

Further objects, features and advantages of the present invention will become more clear from the following detailed description of a preferred embodiment shown in the accompanying drawing, wherein:

FIG. 1 is a perspective view of the tongue toothbrush according to the present invention;

FIG. 2 is a cross sectional view taken along line II—II of FIG. 1;

FIG. 3 is a cross sectional view, similar to FIG. 2, but of a second embodiment of the tongue toothbrush according to the present invention;

FIG. 4 is a perspective view of a third embodiment: and

FIG. 5 is a cross sectional view taken on line V—V of FIG. 4.

DETAILED DESCRIPTION OF A PREFERRED EMBODIMENT

As shown in the perspective view of FIG. 1, the body 1 is of a general cup-shape, having opposite sides 2,3, a top portion 4, a bottom portion 5, and a tip or forward portion 6, all as seen if the device were worn so as to envelope the outer or forward portion of the tongue of a human being, when such person was standing up with their tongue in a normal, relaxed position. The body 1 is continuous, unbroken and homogeneous throughout its entire cup-shaped extent from the peripheral annular innermost edge 7 to the tip portion 6.

A plurality of bristles 8 are arranged in an area on both the top portion 4 and the bottom portion 5 spaced rearwardly from the tip portion 6, spaced forwardly from the edge 7, and spaced from each of the side portions 2,3. As shown, the tip portion 6 is provided with end 9. At any suitable location on the body portion, preferably on the exterior, as opposed to the interior 10, there is formed a coating of water-soluble breath freshener, flavoring, and/or antiseptic material. This material may be coated on the entire exterior and interior of the body, or at selected portions as desired.

In the modification shown in FIG. 3, the body 1' is of substantially the same shape as the body of FIG. 1, except that the conical end 9 that is integrally formed with the body 1 in the first embodiment is replaced by a separate blunt end 9' that is bonded to the tip 6' of the body 1'. The side portions 2' and 3' are each provided with slits 12 (the slit for the side 3' not being shown, although a mirror image of the slit for the side 2') that extends from the edge 7' partway towards the tip portion 6'. The bristles 8' are secured to a base 13, which is, in turn, mounted by means of a pile-type fastener, for example, Velcro, to the body 1. This pile-type fastener 14 may consist of hooks 15 attached to the base 13 and a pile-type fabric 16 attached to the body 1'.

The construction of FIGS. 1 and 2 is preferably such that the same is cheap to manufacture and may be easily disposed of after one or a few uses. Preferably, the body 1 is made of a molded or otherwise formed synthetic resin sheet material of uniform cross section except for the tip portion 6 that is of enlarged cross section as shown in FIG. 2, so as to provide greater rigidity at this portion of the body 1. It is desired to have greater rigidity at the tip portion 6, so that this portion may be used to massage the gums of the user. To assist in such massaging, there is provided the conical end 9 that may be used in the manner of a conventional conical rubber tip on a toothbrush or other appliance. The brushes 8 may be constructed of any suitable brush material that has heretofore been used in the construction of toothbrushes, or other similar material and preferably is embedded or adhesively secured or bonded to the outer periphery of the body 1 at the indicated location. The water-soluble coating is easily applied by known coating methods. If desired, the above construction may be cheaply made and at the time made of edible materials that may be consumed by humans without any ill effects or, in fact, easily digestible by humans. For example, with the edible construction, the body 1 may be made of the same type of material that is used in making casings for sausage, and the bristles 8 may be made of a synthetic resin material normally used in the construction of toothbrushes that will have no adverse affect if ingested by a human being, although such bristles may, in fact, not be digestible.

In contrast to the embodiment of FIGS. 1 and 2, the embodiment of FIG. 3 is of a more permanent construction wherein the casing 1' is constructed of a synthetic resin material or a woven material of more permanency, which may be used repeatedly without wearing out. The coating is substantially the same as the coating in the preceding embodiment. Preferably, the tip portion 6' is provided with the blunted end 9' that is a separate element bonded or otherwise secured to the body 1'. The end 9' is preferably constructed of relatively hard rubber to provide good characteristics for massaging the gums of the wearer. The bristles 8' may be of the same material as the bristles 8, the base 13 may be fabric or synthetic resin material, and the pile-type fastener 14 is of conventional construction.

The tongue toothbrush may be constructed in various sizes to fit different individuals, or it may be expansible to fit a range of individuals or so that one tongue-type toothbrush will fit all individuals. For expansion, the body 1 may be constructed of an elastic film material that will be elastically stretched over the tongue of the user. In contrast, the embodiment of FIG. 3 may be constructed with a slit 12 that will provide for adjustability to an otherwise inelastic body 1'. It is contemplated that the body 1 will be constructed with a slit, such as 12, while the body 1' may be constructed of an elastic material.

The body 1 is of a pliable material that will generally keep its shape when the tongue of a person is inserted within the interior 10, so that the body 1 (the following description is equally applicable to the second embodiment) will envelope the outer portion of the tongue. The material will be non-irritating to the mouth tissue and to the sense of taste. Although the tongue toothbrush may resiliently grip the tongue, it is most preferable that the body does not actually grip the tongue, but rather is kept in place by the pressure of the tongue on the teeth, gums, and walls of the mouth when the device is in use.

The embodiment of FIGS. 4 and 5 has a top portion 4'' that would look identical to the illustration of FIG. 1, that is it would have side portions 2'', 3''', tip portion 6'' having end 9'', bristles 8'' and pad 11'' that would correspond exactly to the correspondingly numbered elements of the embodiment of FIG. 1, which elements also could be modified according to the variation of FIG. 3. The body 1'', including the interior 10'' and edge 7'', and for that matter all other construction, is identical to that of FIG. 1, except for the following differences. The body 1'' further includes a single projection 17 that is slit at only its outer end so that it will tightly grip the terminal end 18 of a dental floss thread 19. The body portion 1'' is also provided with an outwardly extending annular wall 20 that is in one piece with the remainder of the body portion 1'' and further in one piece with two opposed flaps 21, 22 that tightly abut each other along a line of separation 23. This structure provides a storage chamber 24 having therein a coil of stored dental floss thread, which passes through one end of the line of separation 23, where it is tightly gripped so that the dental floss 19 may be stretched between the opposed edges of the flap portions 21, 22 and the projection 17, which stretched portion may, by manipulation of the tongue during usage, be placed between adjacent teeth and moved back and forth to cleanse the area between such teeth. The flaps 21 and 22 are sufficiently resilient that they may be elastically distorted for insertion of the coiled dental floss and sufficiently elastic to tightly grip the dental floss passing between them so that manipulation of the stretched portion of the dental floss will not feed additional dental floss from the stored coil. When the stored dental floss has become sufficiently used to make it desirable to replace the same, the dental floss thread may be grasped between the user's fingers and pulled from the storage chamber to present a fresh supply of dental floss in the stretched position, and the terminal end 18 may be cut off, if desired.

In the embodiments illustrated, there is mounted on the body 1 a self-abrasive pad 11, 11' or 11'' that may be used to polish the teeth after they have been brushed by the bristles 8, 8'', 8''. The previously mentioned coating may be applied in a thin film on the entire surface of the toothbrush by dipping, spraying or the like. In any event, the bristles and the soft abrasive material are provided spaced from the side portions, and the tip portion so that they will avoid irritation with the gums and mouth tissue during usage and so that the tongue may easily control exactly the portions of the mouth and teeth and are to be either brushed or abraded.

It is also contemplated that dentifrice or abrasive material may be applied as a powder or a gel or in combination with a gel mouthwash to only the bristles and soft abrasive material 11, 11' or 11''.

While the present invention has been described with respect to a preferred embodiment, with variations in detail for the purposes of illustration and the importance of the details themselves, further embodiments, variations and modifications are contemplated, all as determined by the spirit and scope of the following claims.

I claim:

1. A tongue toothbrush, comprising:

a hollow cup-shaped body of a size and shape to envelope the outer portion of a human tongue;

said body being constructed of thin, pliable, continuous, elastic sheet material with opposed upper and lower portions, opposed side portions, a peripheral edge and a forward tip, with respect to the normal tongue position of a standing human;

a plurality of bristles secured to at least one of the upper and lower portions adjacent the tip;

an abrasive dentrifice material embedded within said bristles;

said opposed side portions and said tip being completely free of said bristles;

said tip portion being constructed of harder and thicker material than the remainder of said body so as to provide a portion that may be used for the massage of the user's gums;

an easily water-soluble flavoring being secured to said body;

a soft abrasive material being secured to one of said upper and lower portions on the opposite side of said bristles from said tip; and the elasticity of said sheet material being sufficiently elastic to permit expansion and contraction of said body for secure engagement with different sized tongues.

2. A tongue toothbrush, comprising:

a hollow cup-shaped body of a size and shape to envelope the outer portion of a human tongue;

said body being constructed of thin, pliable, continuous sheet material with opposed upper and lower portions, opposed side portions, a peripheral edge and a forward tip, with respect to the normal tongue position of a standing human;

a plurality of bristles secured to at least one of the upper and lower portions adjacent the tip; and the entire tongue toothbrush being constructed of edible material.

3. The tongue toothbrush of claim 2, wherein said opposed side portions and tip are completely free of said bristles.

4. The tongue toothbrush of claim 2, wherein said tip portion is constructed of harder and thicker material than the remainder of said body so as to provide a portion that may be used for the massage of the user's gums.

5. The tongue toothbrush of claim 2, including an abrasive dentifrice material embedded within said bristles.

6. The tongue toothbrush of claim 2, wherein an easily water-soluble flavoring is secured to said body.

7. The tongue toothbrush of claim 2, including pile-type fastener means for releasably securing said bristles to said body.

8. the tongue toothbrush of claim 2, including a soft abrasive material secured to the one of said upper and lower portions on the opposite side of said bristles from said tip.

9. The tongue toothbrush of claim 8, wherein said opposed side portions and tip are completely free of said bristles and said abrasive material.

10. The tongue toothbrush of claim 9, wherein said tip portion is constructed of harder and thicker material than the remainder of said body so as to provide a portion that may be used for the massage of the user's gums.

11. The tongue toothbrush of claim 10, including an abrasive dentifrice material embedded within said bristles.

12. The tongue toothbrush of claim 11, wherein the other of the upper and lower portions includes means for holding spaced portions of dental floss securely so that the intermediate portion may be used to cleanse the opposed surfaces of adjacent teeth by manipulating the user's tongue.

13. The tongue to toothbrush of claim 12, wherein said means includes a storage chamber for holding therein a coil of dental floss integral with said spaced portions.

14. The tongue toothbrush of claim 2, wherein said body is provided with opposed slits extending from said peripheral edge partly towards said tip.

15. A tongue tooth cleanser, comprising:

a hollow cup-shaped body of a size and shape to envelope the outer portion of a human tongue;

said body being constructed of thin, pliable, continuous sheet material with opposed upper and lower portions, opposed side portions, a peripheral edge and a forward tip, with respect to the normal tongue position of a standing human;

wherein one of the upper and lower portions includes means for holding spaced portions of dental floss securely so that the intermediate portion may be used to cleanse the opposed surfaces of adjacent teeth by manipulating the user's tongue;

a storage chamber for holding therein a coil of dental floss integral with said spaced portions, formed in one piece with the remainder of said body;

said storage chamber having an outwardly extending annular wall portion, and two opposed flaps extending therefrom to form an opening for said storage chamber through which the spaced portions of the dental floss extend;

said flaps meeting in tight abutment along a line of separation forming in part the said means for holding one of the spaced portions of dental floss securely; and said means for holding further including an outwardly extending slit projection for holding the terminal end of the dental floss.

16. The tongue toothbrush of claim 2, wherein said sheet material is elastic and the nature of said elastic sheet material permits expansion and contraction of said body for secure engagement with different sized tongues.

* * * * *